United States Patent [19]

Boeshart

[11] Patent Number: 4,791,767

[45] Date of Patent: Dec. 20, 1988

[54] WALE CLAMP

[76] Inventor: Patrick E. Boeshart, R.R. 1, Box 134, Sioux City, Iowa 51108

[21] Appl. No.: 128,220

[22] Filed: Dec. 3, 1987

[51] Int. Cl.[4] ..... C04B 2/00

[52] U.S. Cl. ..... 52/426; 52/309.12; 24/498; 248/316.5; 249/219.2

[58] Field of Search ..... 249/219.2, 219 W; 24/498, 517; 248/316.5, 231.5; 52/426; 412/58

[56] References Cited

U.S. PATENT DOCUMENTS

| | | | |
|---|---|---|---|
| 2,127,562 | 8/1938 | Jennings | 249/219.2 |
| 3,018,538 | 1/1962 | Gates | 249/219.2 |
| 3,216,690 | 11/1965 | Jahn | 249/219.2 |
| 3,792,831 | 2/1974 | Verhey | 249/219.2 |
| 3,835,507 | 9/1974 | Richards | 24/517 |
| 3,874,627 | 4/1975 | Vaught | 249/219.2 |
| 4,487,523 | 12/1984 | Monroe | 24/498 |
| 4,669,234 | 1/1987 | Wilnau | 52/426 |
| 4,730,422 | 3/1988 | Young | 52/105 |

*Primary Examiner*—Henry E. Raduazo
*Attorney, Agent, or Firm*—Zarley, Mckee, Thomte, Voorhees & Sease

[57] ABSTRACT

A wale clamp includes a main body having vertical and horizontal walls. A pivotable handle with a cam on its lower end is connected to the vertical wall and selectively clamps a wale. A removable and adjustable bracket is connected to the horizontal wall of the clamp, and is adjustable to hold varying widths of wales.

12 Claims, 2 Drawing Sheets

WALE CLAMP

TECHNICAL FIELD

This invention relates generally to clamps for use with forming panels in constructing poured-concrete walls, and more particularly to a clamp for holding wale members used to align form panels.

BACKGROUND OF THE INVENTION

While wall forming systems have been in use for many years, a recent development in this industry is in the use of expanded polystyrene panels as forms for poured-concrete walls. After the concrete has hardened, the panels are left in place on the walls to serve as permanent insulation.

In order to hold the panels in straight alignment during the pouring of the concrete, an aluminum bracing system was utilized in the prior art. The aluminum bracing system proved to be cumbersome, not readily available, and difficult and expensive to ship to the various job sites. Furthermore, the use of aluminum beams and cross members as wales in the bracing system made it difficult to adapt the bracing to different job situations, where a wide variety of lengths, heights and widths would be necessary.

The connections between all the various aluminum wale members of the bracing system also required a large amount of time to attach and adjust, and required specialized tools for connecting and disconnecting the system.

Finally, a metal bracing system requires that all of the members be moved from site to site for reuse. This increases shipping costs and labor costs, and reduces the possibility of simultaneous construction of more than one building without additional bracing system materials.

It is therefore a general object of the present invention to provide an improved wale clamp for use with wall form panels.

Another object is to provide a clamp which may be used to hold wale members comprised of on-site construction materials which can be used in the building after being used with the clamp system.

A further object of the present invention is to provide a clamp which is easily connected and disconnected to the wall form panels.

Yet another object is to provide a clamp which may be connected to expanded polystyrene wall panel construction systems.

Yet a further object of the present invention is to provide a clamp that may be attached to wale members without special tools.

These and other objects of the present invention will be apparent to those skilled in the art.

SUMMARY OF THE INVENTION

The wale clamp of this invention includes a main body having a vertical and horizontal wall. A pivotal handle with a cam on its lower end is connected to the vertical wall and serves to selectively hold a wale in the clamp. A removable and adjustable bracket is connected to the horizontal wall of the clamp and will hold varying widths of wale members from sliding transversely out from under the cam. The bracket has one edge bent perpendicularly to form a short wall, and an opposing edge bent slightly off-horizontal in an opposite direction. To hold a wale which is narrower than the width of the horizontal wall, such as with most truss-joists, the bracket is fastened on top of the horizontal wall with the slightly bent edge projecting upwardly. This will hold one flange of a wood truss joist in position, without interfering with the web of the joist. The bracket may be removed, turned over, and fastened to the bottom side of the clamp's horizontal wall with the perpendicularly bent edge projecting upwardly and above the horizontal wall, to hold dimensional-lumber wales (having a width greater than that of the horizontal wall) in position in the clamp. The vertical wall of the clamp has a pair of apertures through which screws may be inserted to fasten the clamp to a form panel. The screws go partially through the panel and are fastened into the end plate of a tie to hold the clamp securely in place.

DESCRIPTION OF THE PREFERRED EMBODIMENT

Figure 1:
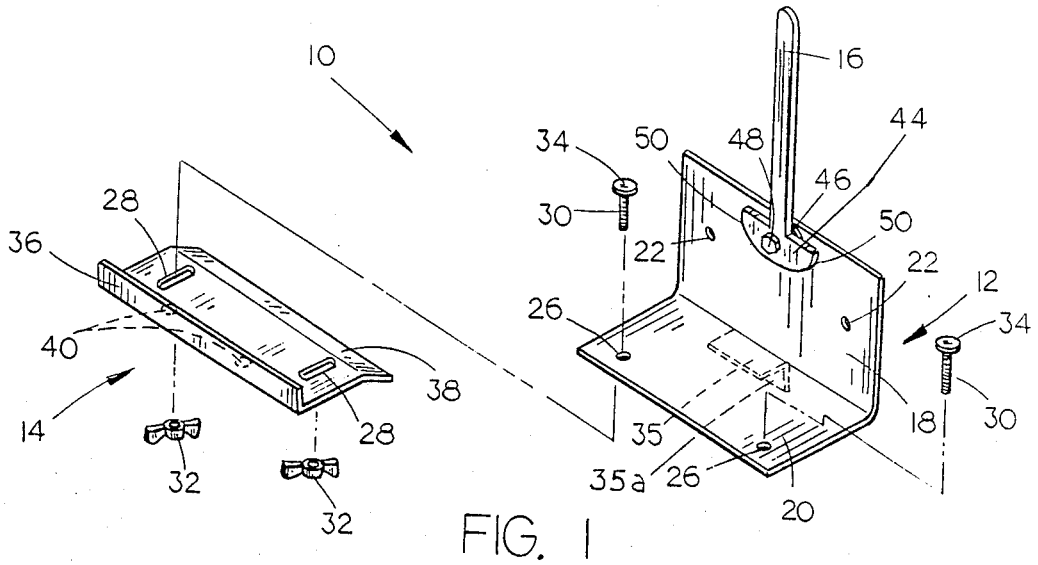
FIG. 1 is an exploded perspective view of the wale clamp of this invention.

Referring now to the drawings, in which similar or corresponding parts are identified by the same reference numeral, the clamp of the instant invention is designated generally at 10, and includes three major components: a body 12, an adjustable bracket 14, and a handle 16.

The main body 12 of clamp 10 includes a generally vertical wall 18 with a horizontal wall 20 projecting from the lower edge thereof. A pair of spaced-apart apertures 22 in vertical wall 18 are countersunk and receive screws therethrough to attach clamp 10 to a wall panel 24.

Horizontal wall 20 of main body 12 has a pair of apertures 26 therein which correspond with a pair of slots 28 in bracket 14. A pair of bolts 30 will project through apertures 26 and slots 28 and is removably fastened in place with wing nuts 32. Bolts 30 have an enlarged flat head portion 34 to reduce the chance of catching and marring the wale member within clamp 10.

An angle member 35 is fastened to the bottom of horizontal wall 20 with one leg **35*a* flush with vertical wall 18. Angle member 35 will serve to stabilize clamp 10 once a wale has been clamped therein, and will also serve as a location for the teeth of a tong-clamp 42**, as will be described in more detail hereinbelow.

Bracket 14 has one longitudinal edge bent perpendicularly to form a short vertical wall 36. The opposite longitudinal edge 38 is bent slightly off-horizontal in a direction opposed to short wall 36, as shown in the drawings. These edges 36 and 38 allow bracket 14 to be inverted, and used with various types and sizes of wales. A pair of spaced-apart apertures 40 are located adjacent short wall 36 and bracket 14, and are designed to receive the legs of a conventional tong-clamp 42 for holding a vertical wale, as will also be described in more detail hereinbelow.

Handle 16 has a cam 44 at one end, and is pivotally connected to the vertical wall 18 of main body 12. Cam 44 on handle 16 pivots around a bolt 46 which projects perpendicularly from vertical wall 18. A nut 48 fastens the handle 16 on bolt 46.

Cam 44 has a pair of opposed cam surfaces 50 which are arranged on cam 44 so as to engage a wale when handle 16 is moved from a vertical position to a horizontal position. The use of two opposing cam surfaces 50 allows the handle 16 to be moved in either direction to engage and clamp a wale under one of the cam surfaces 50.

To align the form panels 24 for pouring a concrete wall, main body 12 of clamp 10 will be fastened to a vertical panel 24 by inserting a pair of screws 52 through apertures 22 in vertical wall 18. Screws 52 will be drawn through the surface of panel 24 and into the flat end plate 54 of a tie 56 (see FIG. 3). Ties 56 are located between pairs of spaced-apart panels 24, and are indicated by a marking on the front surface 58 of the panels 24. This marking allows the ties 56 to be easily located without reference to the interior side 59 of panel 24. Once a clamp 10 has been fastened to panel 24, bracket 14 is loosely attached, via bolts 30 to horizontal wall 20.

Figure 2:
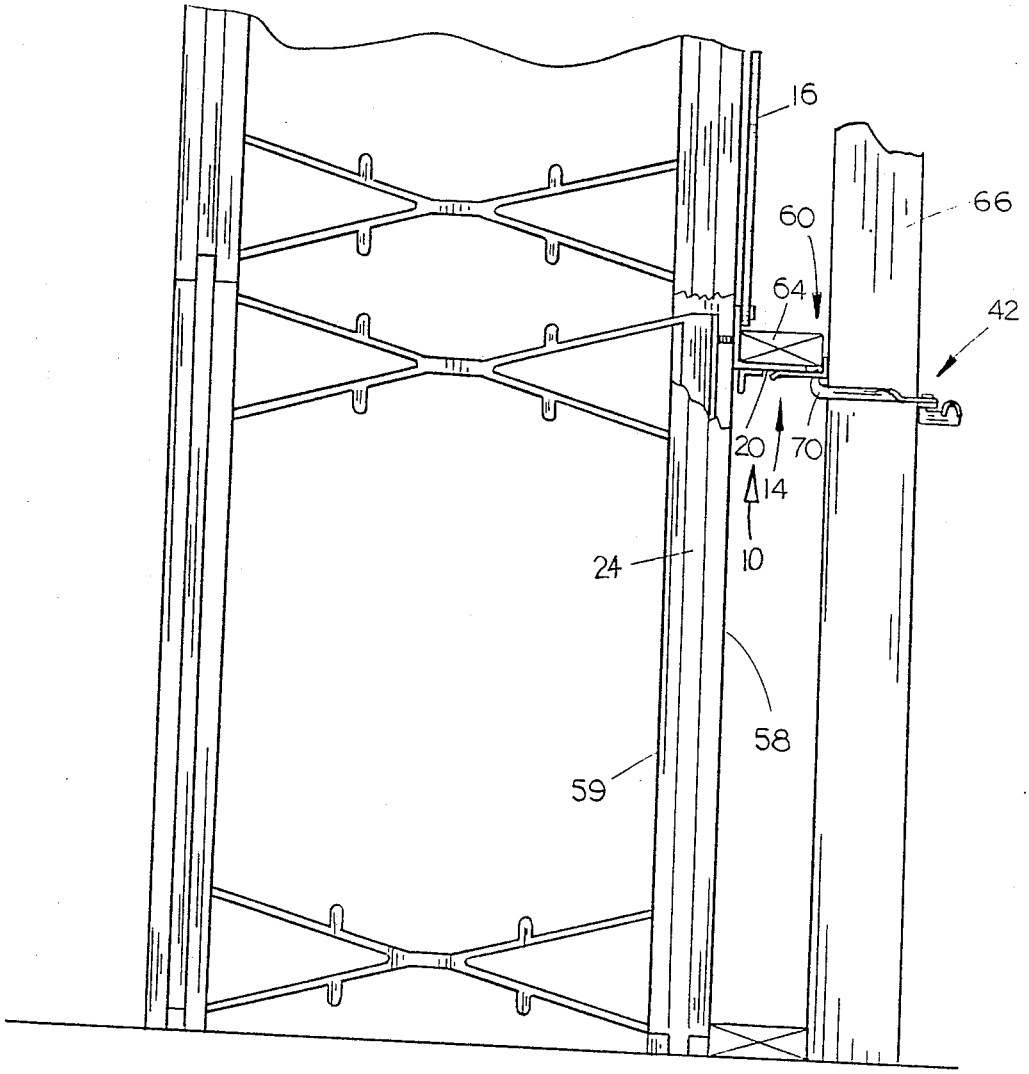
FIG. 2 is a side view of a wall form system with a clamp in place and a dimensional lumber wale member.
Figure 3:
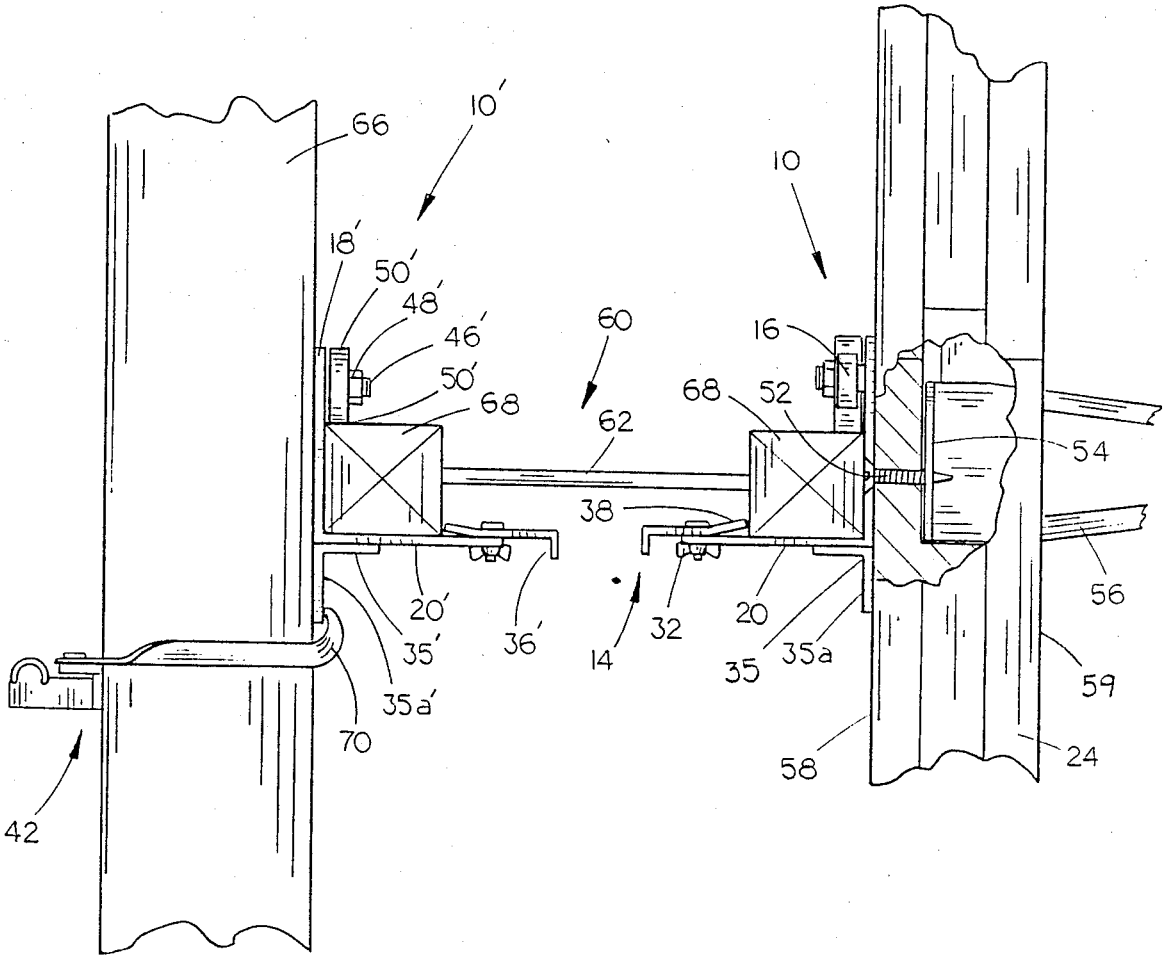
FIG. 3 is an enlarged side view of a wall form system, which shows a clamp in place with a truss-joist type wale member.

If wale 60 has dimensions less than about 2 inches by 2 inches, bracket 14 is attached as shown in FIG. 3, with the slightly-bent edge 38 projecting upwardly. For larger materials, such as a 2×4 or larger, bracket 14 is flipped over and attached under wall 20, as shown in FIG. 2, such that short wall 36 on bracket 14 is directed upwardly.

A wale 60, be it a truss-joist 62 as shown in FIG. 2 or dimensionnal-lumber 64 as shown in FIG. 2, is then laid on top of horizontal wall 20, between at least two horizontally spaced-apart clamps 10. Bracket 14 is then fastened against the wale 60 and tightened in position using wing nuts 32. Handle 16 may then be pivoted so as to force a cam surface 50 against the wale 60 and clamp it in place. Bracket 14 thus holds wale 60 so that it will not slide away from the cam surface 60 during clamping or during use of the clamp 10.

In order to assist in the vertical alignment of wall form panels 24, a vertical wale 66 may be utilized with the invention. If a truss-joist 62 is used as the horizontal wale 60 (see FIG. 3), a second clamp 10' is clamped on the opposite flange member 68', opposite the already affixed clamp 10. Vertical wale 66 is then placed against the vertical wall 18 of clamp 10'. A tong-clamp 42 has a pair of teeth 70 on its legs which will grip leg **35*a*' of depending angle member 35' of clamp 10. Tong-clamp 42 then clamps vertical wale 66 in place. Other clamps 10 and tong-clamps 42 are then attached above and/or below on wale 66 so as to align the vertical wale 66, thereby aligning wall panels 24** vertically.

For those instances where the horizontal wale 60 is dimensional lumber 64, as shown in FIG. 2, the tong-clamp 42 may be directly attached to bracket 14 of clamp 10. This is accomplished by inserting teeth 70 of tong-clamp 42 into apertures 40 of bracket 14.

It can therefore be seen that the wall form clamp of this invention provides a novel device for aligning the form panels used in forming a poured-concrete wall. The use of a handle with a cam allows the clamp to be simply and rigidly affixed to wales, without requiring hammers, nails, bolts or any other tools. Furthermore, it allows readily available materials, such as truss-joists and dimensional lumber, to be used as wales. This allows the wales to then be used in the construction of the building after the walls have been poured. Thus, no system of wales or other bracing need be ordered for a specific job site, nor is it necessary to carry a wale bracing system from site to site. The clamp system also allows use of common materials at the site which are later used in construction, thereby reducing waste.

Since no nails, screws or bolts invade the wales themselves, there is no problem with the structural integrity of the materials after being used as a wale.

It can therefore be seen that the clamp of this invention fulfills at least all of the above-identified objectives.

I claim:

1. A wale clamp for a poured-concrete wall form system, comprising:

a main body having a vertical wall and a horizontal wall;

operable camming means pivotally connected to said vertical wall and spaced above said horizontal wall, including a cam surface for selective engagement with a wale positioned on said horizontal wall;

means connected to said horizontal wall and operable independently of said camming means for holding a wale against said vertical wall and between same camming means and the horizontal wall; and means on said vertical wall for removably attaching said clamp to the wall form system.

2. The clamp of claim 1, further comprising selectively adjustable means for connecting said holding means to said horizontal wall, said connecting means adapted to permit selective and adjustable movement of said holding means towards and away from said vertical wall, to thereby hold variable widths of wales of said horizontal wall.

3. The clamp of claim 2, wherein said holding means and connecting means are connected to said horizontal wall so as to hold a wale having a width less than the width of said horizontal wall.

4. The clamp of claim 2, wherein said holding means and connecting means are connected to said horizontal wall so as to hold a wale of a width greater than the width of said horizontal wall.

5. The clamp of claim 1, wherein said holding means includes:

a generally flat and rectangular bracket having first and second opposing longitudinal edges, said first longitudinal edge being bent vertical to form a short wall; and, means for removably adjustably connecting said bracket to said horizontal wall of said main body.

6. The clamp of claim 5, wherein the second longitudinal edge of said bracket is bent slightly off-horizontal in a direction opposite that of said short wall, wherein said horizontal wall has a top and a bottom side.

7. The clamp of claim 6, wherein said bracket is attached to the top side of said horizontal wall with said slightly off-horizontal bent edge projecting upwardly for use in holding a wale having a width less than the width of the horizontal wall.

8. The clamp of claim 6, wherein said bracket is attached on the bottom side of said horizontal wall with said perpendicularly bent edge projecting upwardly for use in holding a wale having a width greater than the width of said horizontal wall.

9. The clamp of claim 5, wherein said means for removably, adjustably attaching said bracket to said main body includes wing-nut and bolt means connected through apertures in said horizontal wall and through slots in said bracket, the slots being oriented for selective slidable movement of said bracket in a direction perpendicular to the vertical wall of said main body.

10. The clamp of claim 2, wherein said camming means includes a pivotable cam having a pair of cam surfaces, and a handle means attached to said cam for pivoting said cam, said cam mounted to pivot to engage one of said cam surfaces with a wale positioned on said horizontal wall when said handle is pivoted in one direction, and to engage the other cam surface with a wale when the handle is pivoted in the opposite direction.

11. In combination:

a system for forming poured-concrete walls, including first and second form panels, said form panels having interlocking upper and lower edges to form a wall of first panels and a wall of second panels, said panels having an outer face, said panels held in fixed parallel, spaced-apart relation by a plurality of tie members, said tie members having first and second ends, said first and second tie ends having a plate thereon perpendicular to the length of said tie and forming a generally T-shaped end, each said T-shaped end being engaged in one of a plurality of T-shaped slots along the upper and lower edges of said first and second panels with said plate parallel to the outer face of said panel, and a wale clamp for holding wale to align said panels, comprising, main body having a vertical wall and a horizontal wall, the vertical wall attached along its lower edge to a side edge of the horizontal wall;

camming means pivotally connected to said vertical wall and spaced above said horizontal wall;

a cam surface on said camming means for selective engagement with a wale positioned on said horizontal wall; and means on said vertical wall for removably attaching said clamp to a form panel of the wall form system.

12. The combination fo claim 11, wherein said removable attachment means are screw means corresponding with apertures in the vertical wall of said main body, said screw means fastened through one of said panels and into one said plate end of said tie to firmly hold said clamp on said panel.

* * * * *